United States Patent [19]

Martin

[11] 3,991,734

[45] Nov. 16, 1976

[54] STARTING SYSTEM FOR INTERNAL COMBUSTION ENGINES OF THE COMPRESSION IGNITION TYPE

[76] Inventor: John Crawford Martin, 139 Laird Drive, Toronto, Ontario, Canada, M5H 2J7

[22] Filed: Dec. 19, 1974

[21] Appl. No.: 534,424

[52] U.S. Cl. ..... 123/179 E

[51] Int. Cl.[2] ..... F02N 17/00

[58] Field of Search ..... 123/179 E; 290/4 R, 290/4 C; 60/625

[56] References Cited

UNITED STATES PATENTS

| | | | |
|---|---|---|---|
| 2,070,615 | 2/1937 | Plante | 123/179 E |
| 2,123,711 | 7/1938 | Callsen | 123/179 E |
| 2,747,562 | 5/1956 | Wittren | 123/179 E |
| 2,907,891 | 10/1959 | Haas et al. | 290/4 C |

FOREIGN PATENTS OR APPLICATIONS

| | | | |
|---|---|---|---|
| 567,954 | 3/1945 | United Kingdom | 123/179 E |

*Primary Examiner*—Wendell E. Burns
*Assistant Examiner*—David D. Reynolds

[57] ABSTRACT

A starting system for compression ignition engines includes an auxiliary engine of the spark ignition type in combination with a conventional cranking motor of the compressed air or electric type. The components are arranged so that either the auxiliary engine or the cranking motor may be used for starting, or both may be used in tandem. The system is combined in a conveniently mounted equipment.

The starting system comprises, in combination, a cranking motor having a main shaft, clutch means coupled to the main shaft for engaging the main shaft to the crank shaft of an engine to be started, an auxiliary engine of the spark ignition type, and transmission means including a one-way clutch interconnecting the auxiliary engine with said main shaft, whereby to permit said crank shaft to be driven selectively from said cranking motor or said auxiliary engine, or from said cranking motor and auxiliary engine driving in tandem.

4 Claims, 2 Drawing Figures

STARTING SYSTEM FOR INTERNAL COMBUSTION ENGINES OF THE COMPRESSION IGNITION TYPE

This invention relates to a system for starting internal combustion engines of the compression ignition type.

Such engines are generally started by means of a cranking motor, the main shaft of which is adapted to be coupled to the engine crankshaft by an automatic clutch; the cranking motor may be either an electric or a compressed air motor. However, in cold weather conditions compression ignition engines are difficult to start; at low temperatures it is generally necessary to apply a starting torque which is beyond the capability of commercially available electric starting motors, and for a period which is beyond the capacity of compressed air starting motors. It is known to use auxiliary internal combustion engines for starting purposes in certain cases, but this method is highly inconvenient. It is therefore not used in cases where alternative methods are available, or where the main engine may have to be restarted at relatively frequent intervals. For this reason it would be quite impracticable to rely upon the use of auxiliary starter engines in diesel trucks.

The present invention provides a simple, portable equipment which is versatile, and which is particularly suitable for the starting of diesel trucks which have to operate under a wide range of conditions.

According to the invention there is provided an engine starting system in which an auxiliary engine is coupled to a conventional cranking motor, so that the main engine can be driven selectively from either, or alternatively from both driving in tandem.

Figure 1:
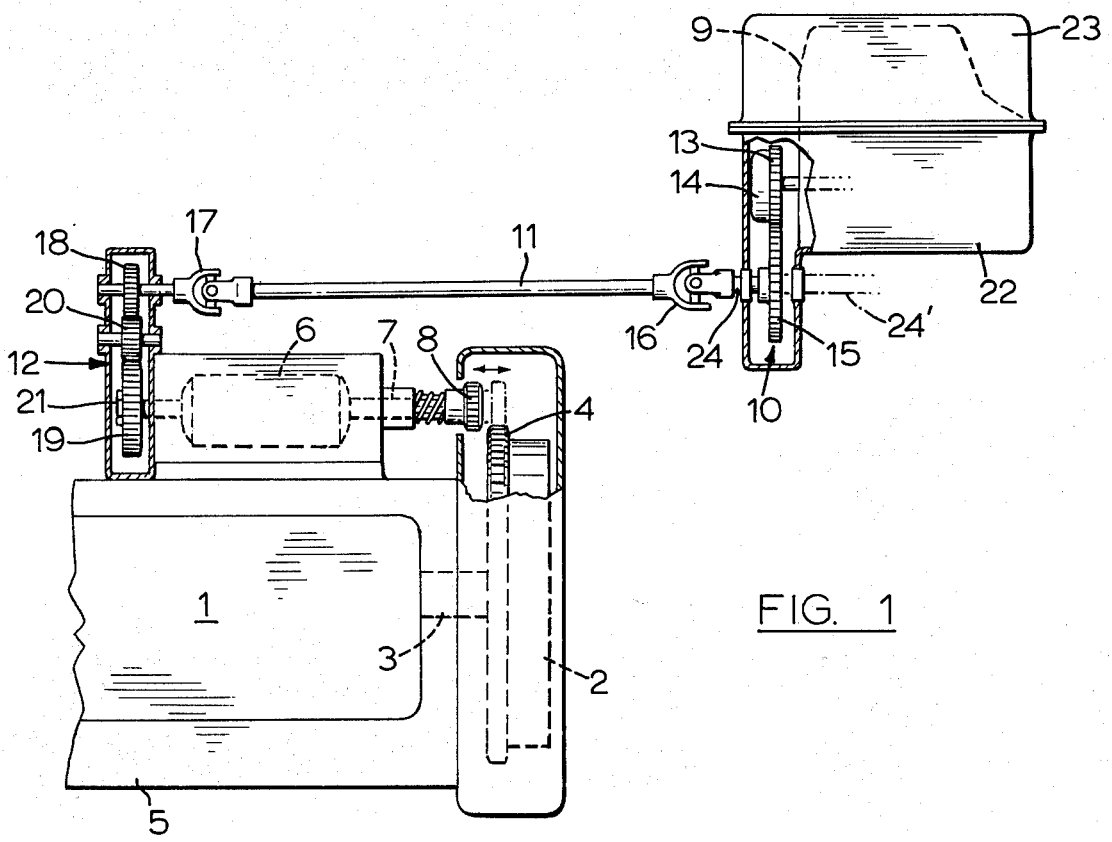
Figure 2:
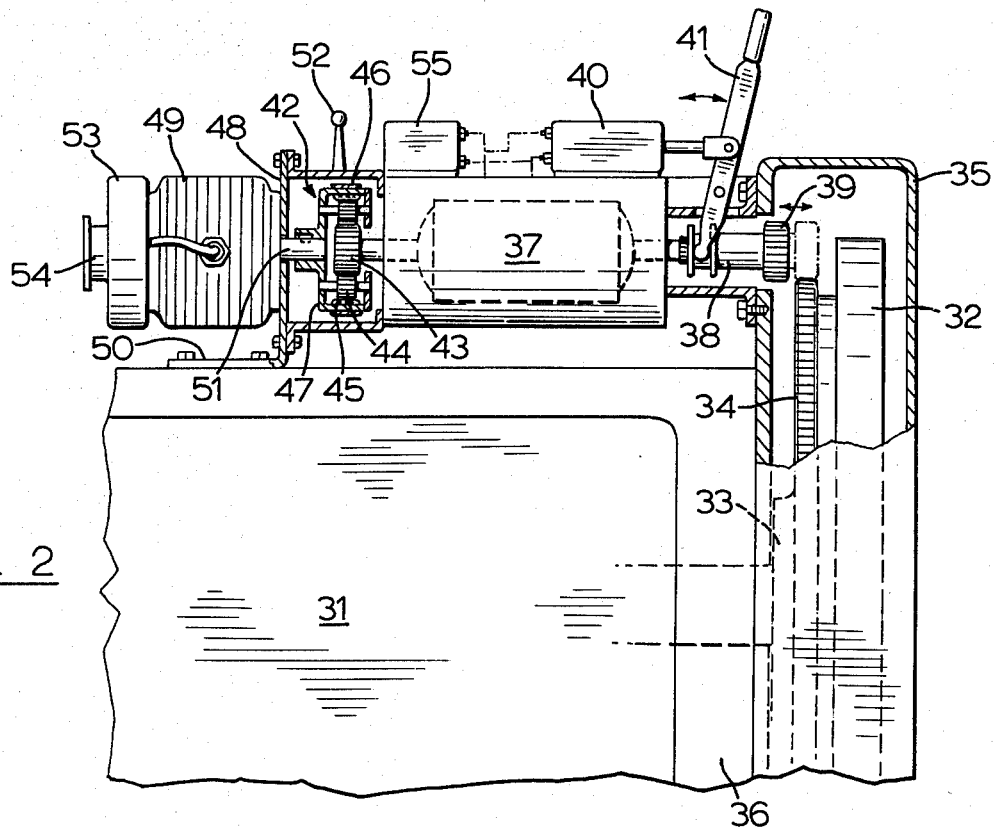

The invention will now be described by way of example with reference to the accompanying drawings, in which FIGS. 1 and 2 are diagrammatic plan views of two engine starting systems according to the invention.

Referring to FIG. 1, a compression ignition engine 1 is shown with a normal flywheel 2 mounted on the crankshaft 3 of the engine. The flywheel 2 carries a starter ring gear 4. Mounted on the casing 5 of the engine 1 is a conventional cranking motor 6, which may be an electric or a compressed air motor. The mainshaft 7 of the cranking motor carries a pinion gear 8 which is actuated electrically or pneumatically in known manner so as to engage the ring gear 4 for starting purposes. The system so far described is a conventional starting system, comprising the cranking motor 6 and automatic clutch means 8 operable to couple the cranking motor to the crankshaft of the engine 1.

However, the starting system also includes an auxiliary engine 9, which in the present example is a two-stroke, spark ignition engine having an electric starter, the auxiliary engine 9 being coupled to the cranking motor 6 through a first gear train 10, a drive shaft 11, and a second gear train 12. The first gear train 10 comprises an input gear 13 which is coupled to the output shaft of the engine 9 by a one-way clutch 14, and an output gear 15 which meshes with the input gear. The output gear 15 is connected to one end of the drive shaft 11 through a universal joint 16. The other end of the drive shaft 11 is connected by a second universal joint 17 to an input gear 18 of the gear train 12. The gear train 12 has an output gear 19 which is mounted on the end of the main shaft 7 remote from the pinion 8, the output gear 19 meshing with an idler gear 20 driven from the gear 18. The gear 19 is mounted on an adaptor 21 fitted to the shaft 7.

In operation of the system, under normal conditions, the engine 1 is started in the conventional manner from the compressed air or electric cranking motor 6. In this mode of operation the auxiliary engine 9 remains idle, the one-way clutch 14 overrunning as the drive shaft 11 is rotated by the cranking motor through the gear train 12. In cold weather conditions, however, the auxiliary engine 9 is started, this normally being well within the capability of the heavy duty batteries of a diesel truck, even under quite severe conditions. In this case the cranking motor 6 remains idle, its main shaft serving merely to transmit the torque from the gear train 12 to the pinion 8. The latter remains disengaged from the ring gear 4 when the auxiliary engine is running at idling speed however, so that the latter may be allowed to warm up before being required to apply a starting torque. Under extreme conditions, where the auxiliary engine itself may not provide sufficient torque to turn the crankshaft of the main engine initially, the cranking motor 6 may be energized for a limited time, thus providing a torque which supplements the torque applied by the auxiliary engine. The system thus provides three modes of operation which may be selected according to the severity of the prevailing conditions.

The auxiliary engine 9 is mounted on a carrier 22, and is protected by a removable cover 23 fitted onto the carrier. The carrier 22 and cover 23 form a casing which completely encloses the auxiliary engine 9, the gear train 10 and one-way clutch 14.

An advantageous feature of the particular system shown in the drawing is that the output shaft 24 of the gear train 10 can be reversed, as indicated in chain-dot at 24'. Thus the carrier 22 may be mounted on either side of the main engine 1, thereby facilitating installation.

Referring now to FIG. 2, the diesel engine 31 has a conventional flywheel 32, connected to the diesel engine crankshaft 33, and carrying a ring gear 34. A conventional flywheel housing 35 is mounted on the rear of the diesel engine crankshaft housing 36, and the flywheel housing incorporates a standard conventional cranking motor machined mounting facing.

The system shown in FIG. 2 comprises an electric cranking motor 37 having at one end a heavy duty overrunning clutch 38 directly connected to a drive pinion 39. The overrunning clutch 38 is axially controlled in known manner by solenoid 40 which provides positive drive pinion engagement before cranking. A lever 41 provides for manual engagement of the drive pinion 39 in the event that there is a complete absence of electric power. The solenoid 40 is a special low voltage output unit permitting reduced speed rotation of the cranking motor 37 without engagement of the drive pinion 39. At the other end of the cranking motor 37 is a planetary gear drive 42 incorporating a pinion sun gear 43 mounted on the cranking motor shaft, a set of planet gears 44 and a ring gear 45. The planetary gear drive is engaged by a brake band 46 engaging with a drum 47 which is carried on the ring gear 45. The planetary gear drive is enclosed in an adaptor housing 48 which is mounted between the cranking motor 37 and a small gasoline engine 49. The cranking motor 37 is mounted on the flywheel housing 35 mounting face in known manner and a simple outrigger support 50 is incorporated to mount, align and carry the reaction from gasoline engine 49. Planet gears 44 are mounted on the end of the gasoline engine crankshaft 51 at one end. At the other end of the crankshaft 51 a simple rope start pulley 54 is mounted. The brake band 46 is actuated by a lever 52 which is pivotally mounted on the housing 48. A flywheel magneto ignition system 53 is provided for the gasoline engine 49.

Under normal circumstances the diesel engine can be started in the conventional manner using the cranking motor 37 supplied with DC power fed from a storage battery through the solenoid 10 in known manner. Under these conditions the cranking motor 37 is completely isolated from the gasoline engine 49 via the freewheeling planetary drive 42 thus permitting the system to operate as a normal electric cranking system of the type in common use today.

In circumstances where it would be difficult, or even impossible, to start the diesel engine by conventional means, owing to cold conditions, the small gasoline engine may be easily started by using a solenoid 55 to feed normal storage battery DC power to the cranking motor 37 and connecting the rotational drive thus obtained by engaging planetary drive 42 and starting gasoline engine 49; alternatively, where DC electric power is not available, the gasoline engine 49 may be started by hand using the pulley 54. When gasoline engine 49 has been started, and with the planetary drive 42 in neutral, the drive pinion 39 is engaged with the ring gear 34 either manually or electrically through solenoid 40 or lever 41 with the pinion 39 engaged and engagement of the planetary drive 42 the combined power of the storage battery fed cranking motor 37 and the gasoline engine 49 are used to crank the diesel engine. Where there is not storage battery power available the power from the small gasoline engine alone is capable of providing sufficient torque and power to crank the diesel engine and provide starting.

What I claim as my invention is:

1. In a starting system for an internal combustion engine of the compression ignition type, the system including a cranking motor having a main shaft, said main shaft providing a first shaft extension extending from one end of the cranking motor and carrying a pinion engageable with a starter gear of the engine for starting the engine, an auxiliary engine of the spark ignition type having a crankshaft, and transmission means including a clutch and gear train interconnecting the crankshaft of the auxiliary engine with the main shaft of the cranking motor, the gear train including an output gear rotatable with said main shaft; the improvement in which the main shaft of the cranking motor provides a second shaft extension extending from the opposite end of the motor coaxially with the first shaft extension and carrying said output gear, said clutch being operable to couple the crankshaft of the auxiliary engine to said gear train for driving said pinion from the auxiliary engine through the main shaft of the cranking motor.

2. A starting system for an internal combustion engine of the compression ignition type, comprising:

a cranking motor having a main shaft, said main shaft providing first and second shaft extensions extending coaxially with one another from opposite ends of the motor;

a pinion carried by the first shaft extension engageable with a starter gear of the internal combustion engine for starting the engine;

an auxiliary engine of the spark ignition type having a crankshaft;

a drive shaft;

a one-way clutch coupled to the crankshaft of the auxiliary engine;

a first gear train including an input gear in driving engagement with the one-way clutch and an output gear connected to one end of the drive shaft through a first universal joint; and a second gear train including an input gear connected to the other end of the drive shaft through a second universal joint and an output gear carried by said second shaft extension and rotatable therewith.

3. A system according to claim 2 wherein the auxiliary engine is a two-stroke engine.

4. A starting system for an internal combustion engine of the compression ignition type, comprising:

a cranking motor having a main shaft, said main shaft providing first and second shaft extensions extending coaxially with one another from opposite ends of the motor;

a pinion carried by the first shaft extension and engageable with a starter gear of the engine for starting the engine;

a sun gear carried by the second shaft extension and rotatable therewith;

an auxiliary engine of the spark ignition type having a crankshaft;

an epicyclic gear train engageable with said sun gear and carried by a planet housing rotatable with said crankshaft; and a clutch selectively engageable with said epicyclic gear train for coupling and uncoupling said gear shaft of the auxiliary engine to and from the second shaft extension of the cranking motor.

* * * * *